US006804907B1

(12) United States Patent
Slobodkin

(10) Patent No.: US 6,804,907 B1
(45) Date of Patent: Oct. 19, 2004

(54) ANATOMICAL HAND GRIP FOR A FIREARM AND METHOD OF SIZE DETERMINATION

(76) Inventor: Gregory Slobodkin, 6 Baron Park La., No. 16, Burlington, MA (US) 01803

( * ) Notice: Subject to any disclaimer, the term of this patent is extended or adjusted under 35 U.S.C. 154(b) by 0 days.

(21) Appl. No.: 10/226,741

(22) Filed: Aug. 26, 2002

(51) Int. Cl.[7] ..... F41C 23/00

(52) U.S. Cl. ..... 42/71.02; 42/94; 42/71.01; 42/85; 42/90; 42/72; 42/74

(58) Field of Search ..... 72/71.02, 94, 71.01, 72/85, 90, 72, 74; D22/104, 108

(56) References Cited

U.S. PATENT DOCUMENTS

D163,654 S * 6/1951 Vahala ..... D22/104
D230,974 S * 3/1974 Howlett ..... D22/104
D252,694 S * 8/1979 Schiermeier ..... D22/108
D255,917 S * 7/1980 Merrill ..... D22/104
D257,166 S * 9/1980 Hogue ..... D22/104
5,465,520 A * 11/1995 Cupp ..... 42/71.02
D374,903 S * 10/1996 Pearce ..... D22/108
5,560,136 A * 10/1996 Cupp ..... 42/71.02
5,797,207 A * 8/1998 Marable et al. ..... 42/71.02
6,073,381 A * 6/2000 Farrar et al. ..... 42/71.02

* cited by examiner

*Primary Examiner*—Jack Keith
*Assistant Examiner*—L. Semunegus
(74) *Attorney, Agent, or Firm*—William Nitkin

(57) ABSTRACT

An anatomical hand grip for a firearm is disclosed providing a trigger finger support protrusion for the positioning of the mid-portion of the distal phalanx of the index trigger finger directly on the trigger.

9 Claims, 5 Drawing Sheets

ANATOMICAL HAND GRIP FOR A FIREARM AND METHOD OF SIZE DETERMINATION

BACKGROUND OF THE INVENTION

1. Field of the Invention

The device and method of this invention reside in the area of hand grips for firearms and more particularly relate to an improved anatomical hand grip for a firearm for the positioning of the mid-portion of the distal phalanx of the index finger directly on the trigger for improved accuracy when firing the firearm and to the method of determining the appropriate size of the hand grip.

2. History of the Prior Art

Hand grips for firearms, such as handguns and long rifles, are well known in the prior art. Such hand grips are often ergonomically formed of materials which are easy to grip, some of which are even compressible, to allow the user to better grasp the firearm handle. Handguns are well known for such grips which often are provided in multiple pieces which pieces are attached to the sides of the handle. Such grips are also utilized on rifles and other types of firearms.

U.S. Pat. No. 6,112,446 to Forster et al discusses the provision of grip panels in different widths and thicknesses to accommodate the different sized-hands of different users. Forster fails to perceive any relationship between the grip size and the importance of centrally positioning the mid-portion of the distal phalanx of the trigger finger on the trigger which positioning is so important for precision aiming of the firearm.

When firing firearms mounted with hand grips of the prior art, care must be taken to balance the force exerted by the user's hand in gripping the handle of the firearm and the pressure on the trigger at the moment of "trigger break." Trigger break occurs immediately before the actual firing of the gun when the trigger loses almost all mechanical resistance to the pulling action of the trigger finger which movement of the trigger finger is not necessarily on the axis of the holding hand. Since the other fingers are still exerting their previous gripping forces, the result is momentary force imbalance with its corresponding turning torque and movement of the firearm. This imbalance of forces can be minimized and corrected by an experienced shooter in his or her aiming, but only if it is reproducible from shot to shot.

SUMMARY OF THE INVENTION

It is an object of this invention to limit the element of force variability caused by the positioning and movement of the trigger finger at the moment of trigger break and thus to improve precision aiming of the firearm. To accomplish this goal the invention herein provides an improved anatomical firearm grip panel having a trigger finger support protrusion for support of the trigger finger to assure its automatic and reproducible placement of the mid-portion of the distal phalanx of the index finger in its optimal position directly in front of the trigger. The device of this invention can be utilized on handguns, semiautomatic handguns, revolvers, rifles, and any other firearm that utilizes a hand grip adjacent to the trigger mechanism. It should be noted that although a semiautomatic pistol is illustrated and discussed herein, the device of this invention can be utilized on any of the aforementioned types of firearms. Further, although the illustrations depict the invention utilized by a right-handed user, it should be noted that the device can be produced and utilized on the opposite side of the handgun for use by left-handed users. Thus the device of this invention should be considered to include a grip panel that not only can be constructed for right-handed users but also can be constructed for left-handed users as well. In addition, although the device of this invention is discussed and illustrated in a most typical configuration of having two separate side grip panels affixed to a firearm handle, it should also be considered as including one-piece wrap-around grips as well as gun handles with grip geometry integrally molded in them.

In firing a firearm, the precise placement of the mid-portion of the distal phalanx of the trigger finger/index finger on the firearm trigger is critical to accurate shooting. Existing firearm grip designs do not provide positioning support of the trigger finger. While such prior art grips are frequently standardized and found comfortable by users, they allow the user too much latitude in positioning the trigger finger, ranging from placing the very tip of the trigger finger on the trigger to placing the base of the distal portion of the index finger on the trigger, both of which placements are undesirable for accurate shooting of the firearm. The placement of the trigger as close as possible to the axis of the holding hand is most desirable to minimize turning torque with regard to the axis of the holding hand upon the firing of the gun. Further, minimizing the mechanical resistance provided by the trigger of the firearm will also reduce such turning torque. Trigger pulls of normal military or law enforcement firearms are in the range of 3–7 lb. Hair triggers have pulls within the range of 0.5–2 oz and are very specialized in their applications. Their usage is limited by safety considerations and often by sporting rules.

The device of this invention extends the support of the trigger finger on the hand grip to a point somewhat beyond the second finger joint to aid in the elimination of what can be referred to as "trigger finger play." When using on a handgun the hand grip of this invention on a hand gun that has been specially selected for that user, the user tightly grasps the handgun and automatically the mid-portion of the distal phalanx of his trigger finger is positioned directly at the correct point in front of the trigger. Since human hands come in a variety of different sizes with varying finger lengths, the size of the trigger finger support protrusion of the hand grip of this invention required to position a user's fingers properly on a standard firearm frame will differ depending upon the length of the user's palm and index finger. To determine the proper size of the trigger finger support protrusion, a method is disclosed herein for the determination of the parameters so that a user can be personally measured for the selection and installation of the correct sized grip to create a firearm for that user which will correctly position the mid-portion of the distal phalanx of the trigger finger of that user directly in front of the trigger.

In target shooting, the technique is to exert a gripping force on the firearm as close as possible to the axis of the holding hand. The main gripping force is exerted by the middle finger and thumb of the shooting hand with the middle finger contracting and pulling the firearm toward the palm of the hand and the thumb providing the side support. This positioning of the middle finger and thumb allows the index finger or trigger finger to be steadily pulled rearwards on the trigger. Once the trigger finger is positioned correctly on the trigger by the device of this invention, not only can the pulling of the trigger be reproducible with a force-balanced grip, but also the user's firing accuracy can be improved when combined with other techniques, such as breath and other body movement controls.

The use of the device of this invention helps create a grip which provides for very reproducible results since it optimizes and standardizes the position of the trigger finger against the trigger and reduces the ability of the user to position the trigger finger incorrectly.

A further consideration of this invention is that variations in grip thickness are important relative to the contact areas of the thumb and fingers and palm around the grip of the handgun. A typical thumb area contact around the side of the gun is either a thumb rest which is an open-ended small shelf on the upper left side of the grip or an open area on the left grip panel of the gun where the thumb can easily accommodate extending along the upper part of the left grip panel. The other fingers also have an area where they can securely grip the handle of the gun, such as the contact area for the middle finger which includes its proximal phalanx against the right grip panel, the middle phalanx against the front of the handle, and front of the distal phalanx against the left panel. Middle fingers of various lengths can easily accommodate a grip by wrapping around the grip with slightly different joint angles. Thus the grip for the middle finger and other fingers can be much narrower in configuration than the trigger finger support protrusion of this invention, allowing the grip to be much narrower below the trigger finger support protrusion, as described below, which trigger finger support protrusion positions the mid-portion of the distal phalanx of the index finger in the desired position in front of the trigger. With the exception of the trigger finger which moves, the other fingers wrap around the handle of the gun with no difficulty in achieving a reproducible grip; and although molded finger grooves formed within a grip are common in grips, such feature is not absolutely necessary since the middle, ring and little fingers are merely used to grasp the lower narrower portion of the grip and do not affect the proper placement of the trigger finger against the trigger. Further, the trigger finger support protrusion can be provided separately from the lower grip portion or can even be applied onto an existing grip.

It is yet a further object of this invention to provide an improved firearm grip that can be utilized in a multitude of construction methods such as, for example, formed of separate attachable side panels to a standard handgun frame, or formed as part of integral or unitary grips which can be molded from plastic. It should be noted that the structure of the grip of this invention can be incorporated into many different grip forms that are in popular use but which do not benefit from the present invention and method of determining the size of the trigger finger support protrusion of this invention.

It should be noted that in order to determine the parameters of the trigger finger support protrusion of the hand grip of this invention a tape can be attached at one end to the rear of a handgun frame without any grips thereon. The tape has a plurality of measurement indicia thereon, as described further below, against which one can position one's hand with the thumb hooked around the grip in its normal position. One can then measure the length where the mid-portion of the distal phalanx of the trigger finger is located on the tape, as seen in FIG. 3, and that length measurement can be used to determine the size of the trigger finger support protrusion that would be selected and mounted on the handgun frame from a series of grips, which series can be part of a kit containing many different sizes for the purpose of selecting the correct size for each user of a handgun. It is critically important to determine the profile geometry of the trigger finger support protrusion for a particular brand of handgun frame and using the methodology of this invention appropriate grips for handgun frames of different brands to make the invention universally acceptable for utilization on a variety of firearm handles.

DESCRIPTION OF THE PREFERRED EMBODIMENT(S)

Figure 1:
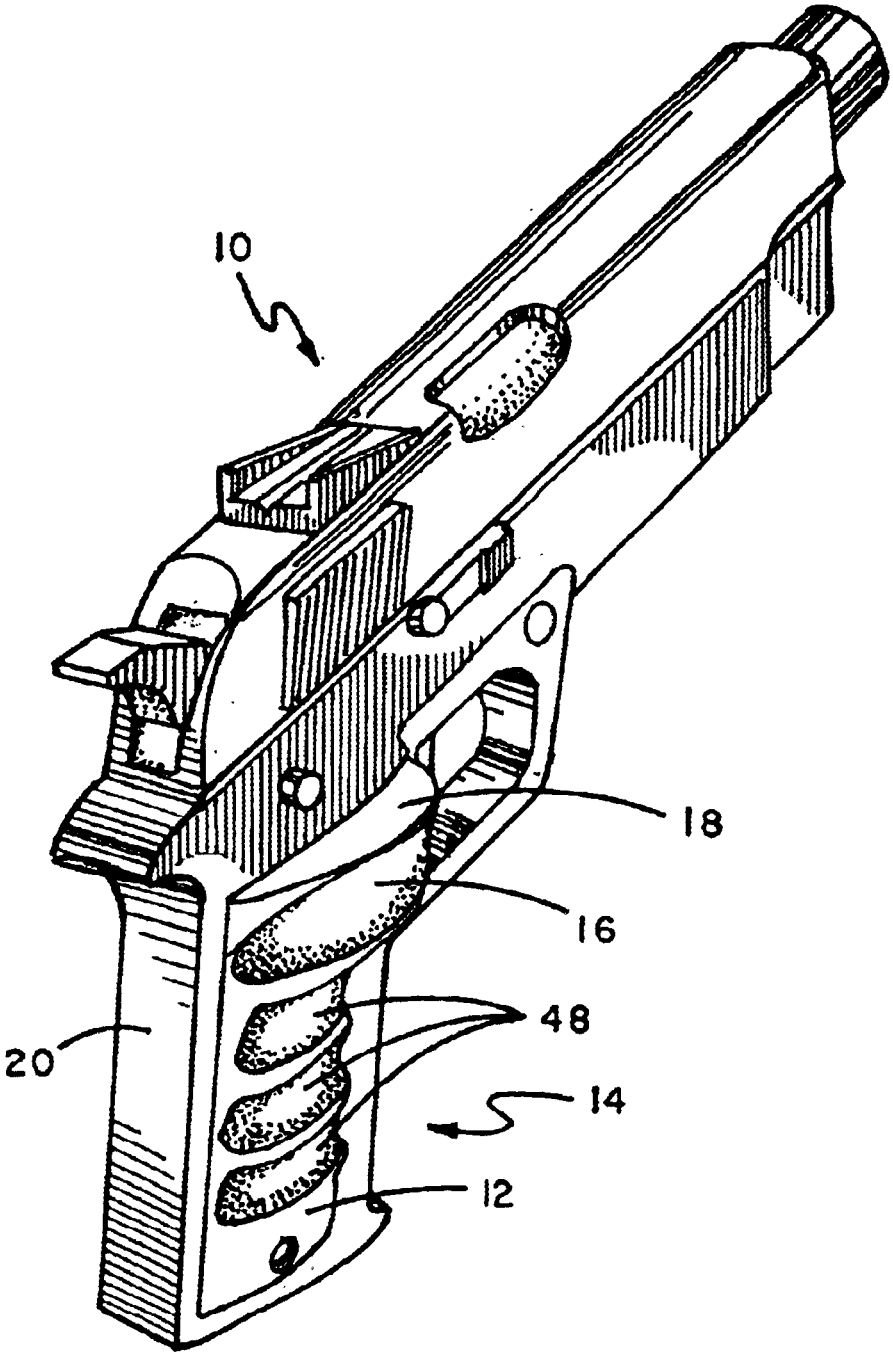
FIG. 1 illustrates a rear side perspective view of a handgun with the hand grip side panel of this invention mounted thereon.
Figure 1A:
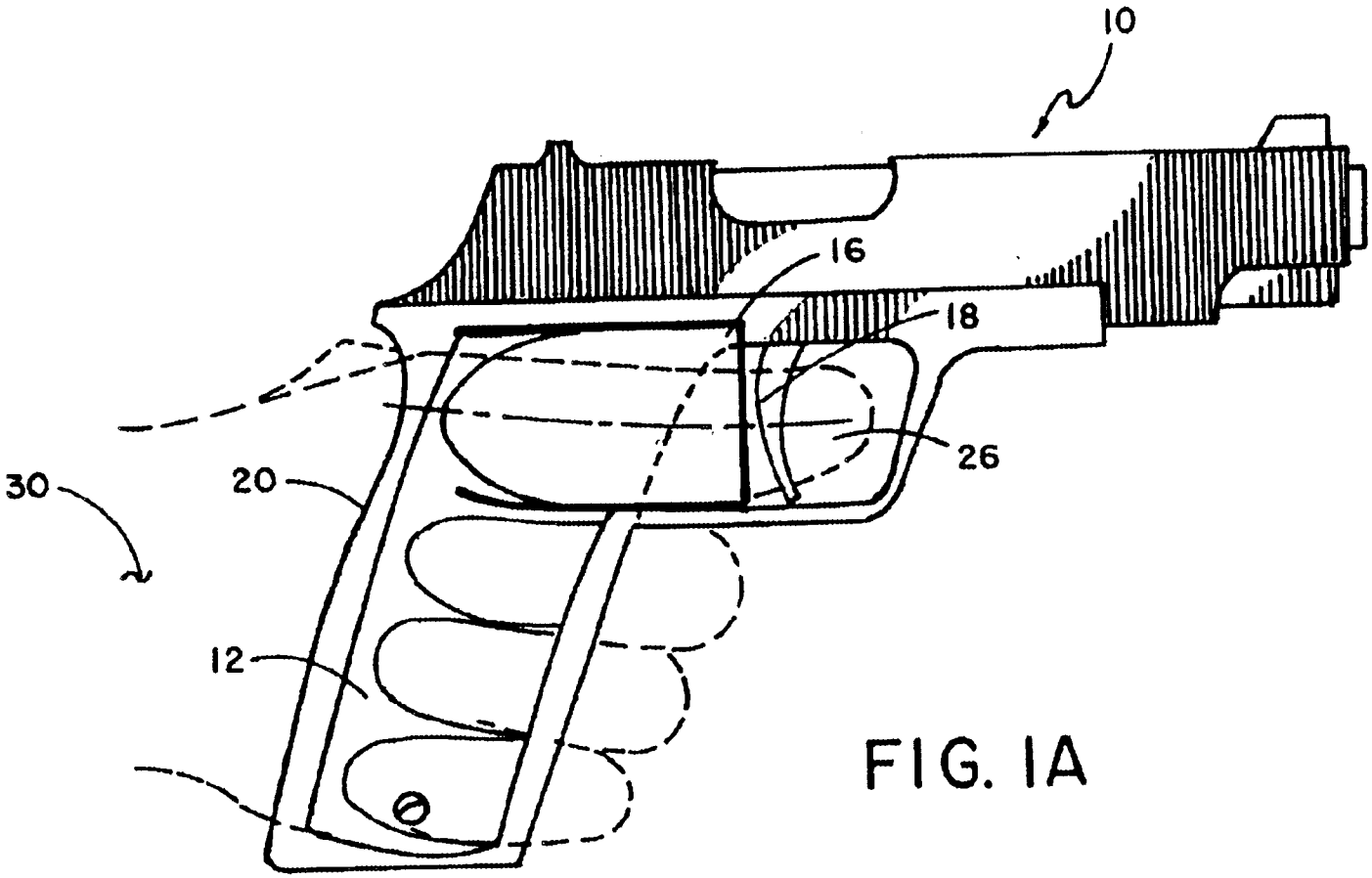
FIG. 1A illustrates a right side view showing the grip of this invention.
Figure 2:
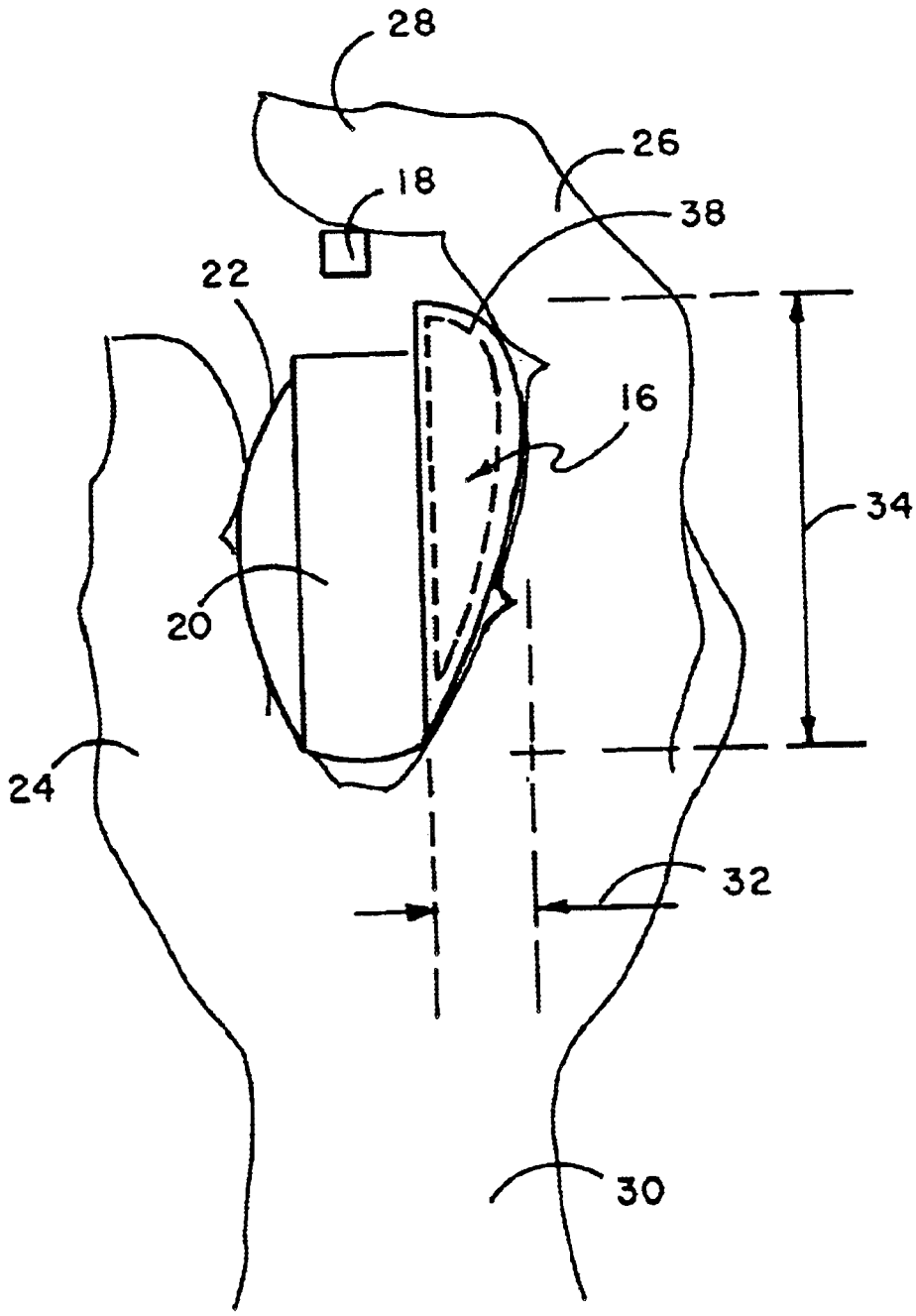
FIG. 2 illustrates a top view through a section of a handgun with the hand grip side panel of this invention mounted thereon showing a user's hand with the trigger finger correctly positioned on the trigger.

FIGS. 1 and 1A illustrate, respectively, a rear perspective view and a right side view of handgun 10 having handle 20 on the right side of which is mounted hand grip side panel 12, also referred to as grip 12, of this invention. Grip 12 includes a plurality of molded finger grooves 48 within lower grip portion 14 and a substantially D-shaped, in thickness profile, trigger finger support protrusion 16 of this invention which positions the index finger at a position to align the mid-portion of the index finger's distal phalanx directly over the trigger. To provide the optimum support to the index finger in the areas of the proximal phalanx and the middle phalanx of the index finger, this protrusion 16 is made with a substantially D-shaped profile with both greater thickness and greater extension towards the trigger than the upper part of its companion panel 22. The front part of protrusion 16 is significantly displaced forward towards the trigger so that the upper part of grip panel 12 is significantly wider than the corresponding part of its companion panel 22. Such forward displacement is new in comparison with the essentially small symmetrical grip panels of the prior art. This protrusion is aligned to the trigger and is thicker towards the trigger and thinner near the rear of the gun to better fit the shape of the hand while correctly positioning the trigger finger over the trigger, as is illustrated in FIG. 2. This protrusion can also have a finger groove in it.

As protrusion 16 is designed to provide support for the index finger without interfering with the positioning of the middle, ring and little fingers of the shooter's hand, the side view of this D-profiled protrusion 16 includes the shape of a straight band aligned to the gun's trigger with its width slightly greater than that of the index finger which it is designed to support. Protrusion 16 is positioned in the upper part of grip side panel 12 and is aligned between the crook of the user's thumb/gun handle contact point and the middle of the trigger of a particular gun frame. The width of protrusion 16 may vary along the protrusion length depending on, among other things, the aesthetics of a particular grip and particular gun frame design, and more specifically the presence of gun mechanism levers and buttons close to the upper part of the grip side panel, for these controls, if present, must be kept accessible to the fingers of the shooter's hand. The right side view of protrusion 16 and its alignment to the gun frame are illustrated in FIG. 1A.

This alignment depends on the design of the particular gun frame and is identical to the position and orientation of the trigger finger of a person holding such gun in his/her hand. It is approximately horizontal for some popular handgun frames, for example, the frame of the CZ-75 pistol. For certain other pistol frames it is somewhat sloping downward towards the gun trigger. For some revolver frames this downward slope is more pronounced. While this description and illustrations relate to a horizontally oriented D-profiled trigger finger support protrusion 16, it should be understood that this invention equally embodies and includes designs with a downward sloped D-profiled protrusion 16 with the length measurements of protrusion 16 carried out along the direction provided by the position of the trigger finger it is designed to support.

Figure 3:
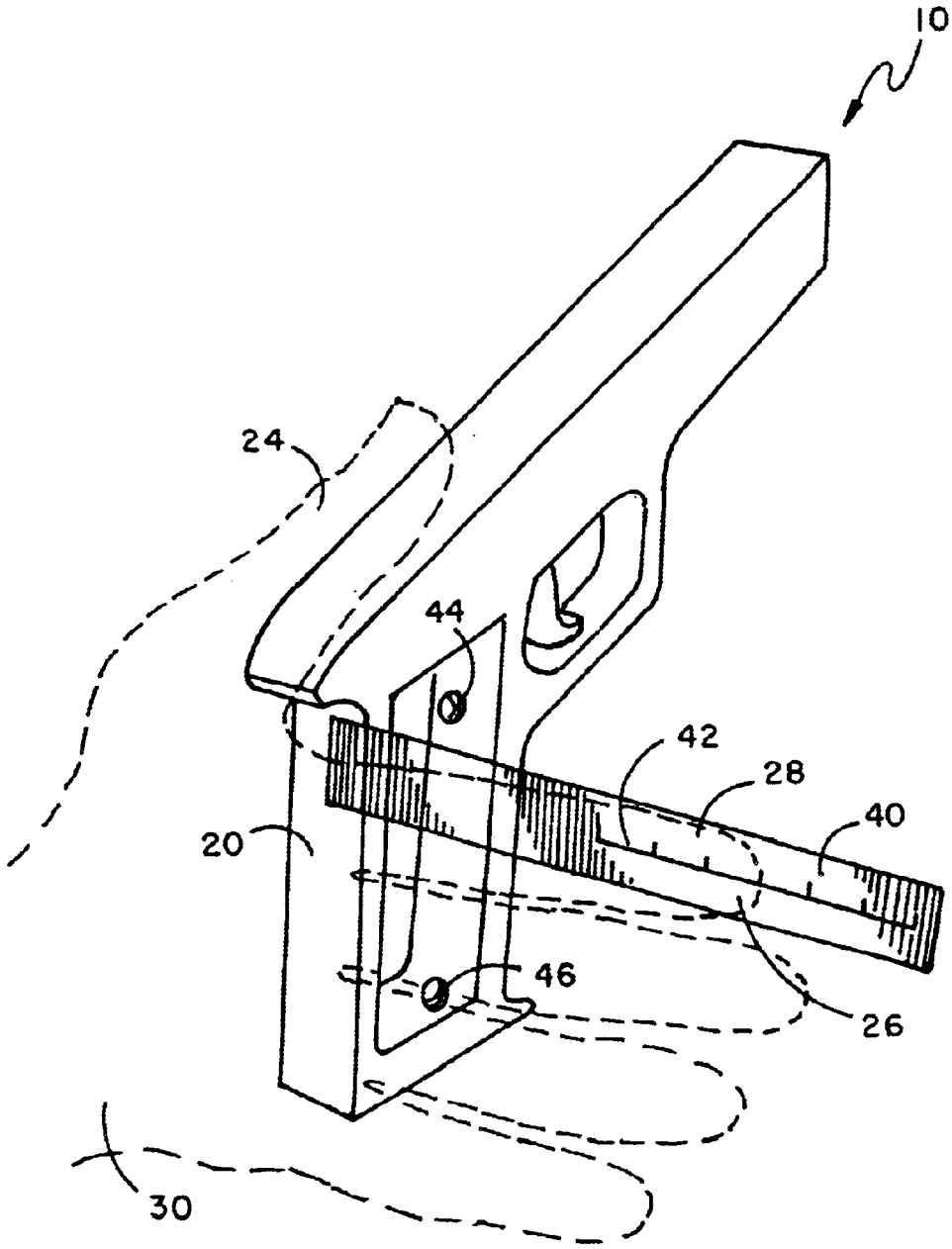
FIG. 3 illustrates the frame of a handgun with the user's hand, shown in outline form, being measured by a tape with measurement indicia thereon to determine the selection of a hand grip having the appropriately sized trigger finger support protrusion for that particular user.

In determining the correct size of the trigger finger support protrusion, one must determine the length of the index finger defined here as the distance between the crook of the user's thumb out to the middle of the distal phalanx of the outstretched index finger. Such distances can correspond to the size of the trigger finger support protrusion required for attachment to particular models of handguns. One can determine the length of the index finger by aligning the index finger with a tape, as described further below, on a gun frame, as seen in FIG. 3.

In FIG. 2 one sees a cross-section through the gun hand immediately above the trigger finger support protrusion 16 of this invention with the balance of the handgun not shown. In this top view can be seen handle 20 and trigger 18 surrounded by the user's hand with the wrist portion 30 located behind handle 20. Thumb 24 is wrapped around over second side panel 22. The top part of second side panel 22 is of a smaller typical thickness than the thickness of trigger finger support protrusion 16 which is made thicker than the corresponding part of second side panel 22 to fit within the palm of the hand and within the proximal phalanx area and middle phalanx area of the index finger in order to position the index finger's distal phalanx portion 28 centered in front of trigger 18.

By providing profile circumference 38 of the substantially D-shaped trigger finger support protrusion 16 with sufficient thickness 32 and sufficient length 34, the hand portion and index finger 26 are moved away from handle 20 of the handgun so as to place the mid-portion of the index finger's distal phalanx 28 immediately in front of trigger 18. Thus the trigger cannot be aligned with the inner or outer portion of the index finger distal phalanx.

By providing an enlarged, substantially D-shaped trigger finger support protrusion 16 disposed above the smaller molded finger grooves 48 at the level of trigger 18, as seen in FIGS. 1 and 1A, the user can grasp the handgun, with the middle, ring and little fingers extending around molded finger grooves 48 of lower grip portion 14 and the thumb extending around the other side of the grip, while the index finger extends around the trigger finger support protrusion 16 of grip 12 so as to position the mid-portion of the distal phalanx of the index finger directly in front of trigger 18.

To determine the profile geometry of trigger finger support protrusion 16, one needs to first measure the length of the index finger defined here as the distance between the crook of thumb 24 out to the mid-portion of the distal phalanx of the outstretched index finger. FIG. 3 shows the thumb engaged around handle 20 of handgun 10 and the index finger extending outward along tape 40 which tape has a plurality of measurement indicia forming scale 42 therealong. The fingers are extending outward with the index finger against tape 40 which is attached to the upper rear portion of the handle of a handgun frame. One can then measure the length of the index finger by noting where the mid-portion of the distal phalanx matches against measurement indicia 42 of tape 40 and determine from that measurement which size grip panel containing the correct size trigger finger support protrusion to attach to that gun model.

Figure 4:
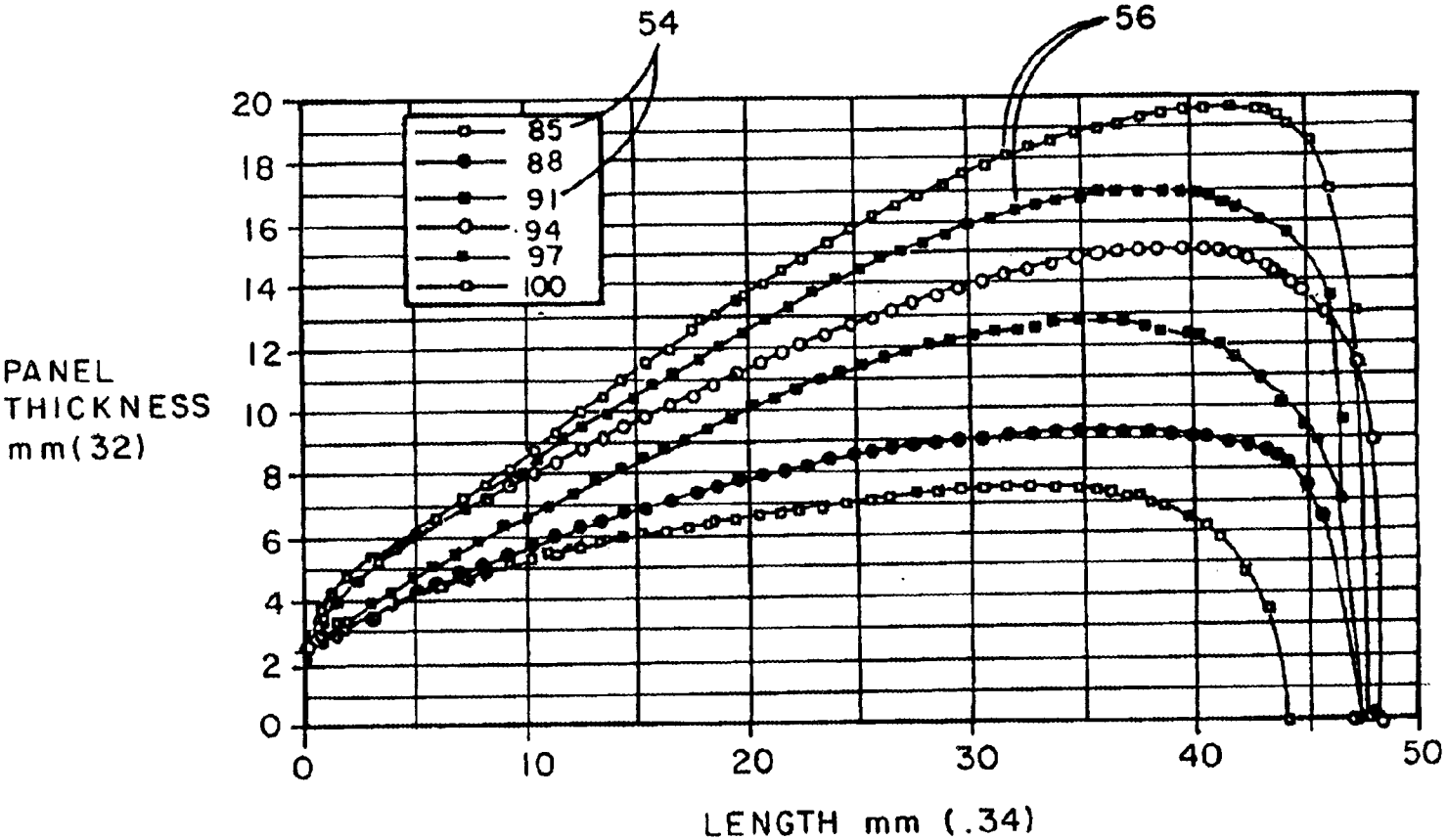
FIG. 4 illustrates a chart of various sizes and shapes of the trigger finger support protrusion of this invention based on different measured lengths of the trigger finger supporting curves as measured according to the method of this invention on grip panels specifically fitted on a Colt 1911 full-size pistol frame.

As depicted in FIG. 2, the trigger finger placed onto the trigger displays skin folds which would make measurements of a finger placed on a trigger difficult. However, with the same tape arrangement it is possible to determine the length of the trigger finger supporting curve, from the crook of the user's thumb/gun handle contact point around trigger finger support protrusion 16 and to the middle of trigger 18. This length has been found to be essentially constant for the same user with regard to different handguns and represents the individual user's characteristic, because while human skin is pliable, it is not particularly stretchable, and most handguns, at least within the same class, like that of combat pistols with full-sized frames, have sufficiently similar frame dimensions. It has been further found that for fingers of normal thickness the length of this curve is approximately 83% of the finger length as described above. This number (the length of the trigger finger supporting curve in millimeters) has been used as the support protrusion size designator 54 in FIG. 4 illustrating the profiles of different size trigger finger support protrusions 16 fitted for a popular Colt 1911 full size pistol frame. The significance of the measurement of the index finger to the center of the distal phalanx is to determine the related length of trigger finger supporting curve and thus the size of trigger finger support protrusion 16.

There can be various methods of attachment because the handgrip panels that can be utilized can consist of different number of pieces, or can be made of many different materials whether they be hard or resilient, and such handgrips can be attached in various manners.

By selecting a handgun grip side panel from a kit in one embodiment with trigger finger support protrusions available in a variety of sizes varying by thickness (the protrusion length and width are essentially constant for the same make of handgun frame, as illustrated for the protrusion length in FIG. 4) which would be in the range of five or six different sizes for each particular brand of handgun, the user can determine the closest size. For an even more precise fit that particular pre-made substantially D-shaped trigger finger support protrusion of the grip panel can be lightly filed or sanded. The geometry of lower grip portion 14, though, of the grip is of less importance so long as the fingers surround the handle in typical fashion for a secure grip with the thumb on the opposite side of trigger finger support protrusion 16. The measurements, both of the index finger and of the trigger finger supporting curves provided by protrusions 16 of various sizes, can be made with tape 40 as described above and illustrated in FIGS. 2 and 3. A plurality of hand grip side panels, each with a different-sized trigger finger support protrusion having a substantially D-shape that extends outward from the palm area of the hand and then curves sharply inward toward the trigger, can be provided.

Although the present invention has been described with reference to particular embodiments, it will be apparent to those skilled in the art that variations and modifications can be substituted therefor without departing from the principles and spirit of the invention.

What is claimed is:

1. A hand grip panel for a gun to be held in the hand of a user, said gun having a trigger and a handle, said hand grip panel having a finger-contacting side and a thumb-contacting side and an upper portion and a lower portion for attachment to said gun handle, comprising:

a trigger finger support protrusion disposed in the upper portion of said finger-contacting side of said hand grip panel on said gun handle, said trigger finger support protrusion being thicker and of greater extension toward said trigger than said hand grip panel's lower portion, said trigger finger support protrusion of a selected size for positioning the mid-portion of the user's distal phalanx of the index finger directly in front of the gun's trigger.

2. The hand grip panel of claim 1 wherein said trigger finger support protrusion has a flat side and said flat side of said trigger finger support protrusion is affixed to said gun handle.

3. The hand grip panel of claim 1 wherein said lower portion of said hand grip panel is disposed beneath said trigger finger support protrusion for grasping by said user's middle finger, ring finger and little fingers.

4. A gun hand grip panel kit comprising:

a series of hand grip panels, each having a substantially D-shaped trigger finger support protrusion of a different size aligned to the gun trigger for affixing to a gun handle of a gun, one of said panels with its particular protrusion to be selected to match an individual user's index finger length to cause the positioning of the mid-portion of said user's index finger distal phalanx to be positioned directly in front of the gun's trigger.

5. A method of aligning the mid-portion of the distal phalanx of the index finger of a user's hand in front of the trigger of a gun having a gun handle, said gun handle having a finger-contacting side and a thumb-contacting side, comprising the steps of:

providing a trigger finger support protrusion on said finger-contacting side of said handle, said finger protrusion being of greater thickness and greater extension toward said trigger than the rest of said handle, said trigger finger support protrusion aligned between the contact point of the crook of the user's thumb with said handle and the middle of said trigger; and selecting said trigger finger support protrusion to be of sufficient size to fill the palm area, proximal and mid-phalanx areas of the user's index finger between said gun handle and the position of said index finger to cause the alignment of the mid-portion of the user's distal phalanx of the index finger to be immediately in front of said trigger.

6. A method of aligning the mid-portion of the distal phalanx of the index finger of a user's hand in front of the trigger of a gun having a gun handle, comprising the steps of:

providing a substantially D-shaped trigger finger support protrusion of a selected size having a width somewhat greater than the width of the index finger of the user, said trigger finger support protrusion aligned between the contact point of the crook of the user's thumb with said handle and the middle of said trigger;

selecting said substantially D-shaped trigger finger support protrusion to be of sufficient size to fill the palm area, proximal and mid-phalanx areas of the user's index finger between said gun handle and the position of said index finger to cause the alignment of the mid-portion of the user's distal phalanx of the index finger to be immediately in front of said trigger, further including:

providing a tape attached to the rear of said gun handle, said tape having measurement indicia thereon;

positioning the user's hand with the gun handle in the crook between the thumb and palm and extending the index finger along said tape;

observing the measurement indicia of said tape opposite the mid-portion of said distal phalanx of said index finger;

calculating the corresponding length of the trigger finger supporting curve;

providing a hand grip panel having a substantially D-shaped trigger finger support protrusion of a size corresponding to said calculated measurement; and installing said hand grip panel having a substantially D-shaped trigger finger support protrusion on said gun with said protrusion aligned to the gun's trigger.

7. The method of claim 6 further including, between the step of providing a grip panel with a substantially D-shaped trigger finger support protrusion and the step of installing said panel, the steps of:

providing a series of grip panels, each having a substantially D-shaped trigger finger support protrusion of different sizes, each size corresponding to an indicia measurement on said tape; and selecting said grip panel having a substantially D-shaped trigger finger support protrusion that corresponds to the observed indicia measurement.

8. A hand grip panel for a gun to be held in the hand of a user, said gun having a trigger and a handle, said hand grip panel integrally molded to said gun handle, said panel having a finger-contacting side having an upper part and a thumb-contacting side, comprising:

a trigger finger support protrusion disposed in the upper part of said hand grip panel on said finger-contacting side, said trigger finger support protrusion being of greater thickness and greater extension toward the trigger than the lower portion of said panel, said trigger finger support protrusion having a width somewhat greater than the width of said user's index finger and aligned between the contact point of the crook of the user's thumb with said handle and the middle of said trigger, said trigger finger support protrusion of a selected size for positioning the mid-portion of the user's distal phalanx of the index finger directly in front of the gun's trigger.

9. A hand grip accessory for a gun to be held in the hand of a user, said gun having a trigger, a handle and a hand grip panel attached to said gun handle, said panel having a finger-contacting side having an upper part and a thumb-contacting side, comprising:

a trigger finger support protrusion attachment disposed on the upper part of said finger-contacting side of said grip panel on said gun handle, said protrusion attachment being of greater thickness and greater extension toward said trigger than said lower part of said panel, said attachment having a width somewhat greater than the width of said user's index finger and aligned between the contact point of the crook of the user's thumb with said handle and the middle of said trigger, said trigger finger support protrusion attachment being of a selected size for positioning the mid-portion of the user's distal phalanx of the index finger directly in front of the gun's trigger.

* * * * *